US011913190B2

(12) United States Patent
Ito et al.

(10) Patent No.: US 11,913,190 B2
(45) Date of Patent: Feb. 27, 2024

(54) WHEEL LOADER

(71) Applicant: HITACHI CONSTRUCTION MACHINERY CO., LTD., Tokyo (JP)

(72) Inventors: Kazuyuki Ito, Kobe (JP); Yoshikazu Urimoto, Kakogawa (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 554 days.

(21) Appl. No.: 17/271,748

(22) PCT Filed: Dec. 13, 2019

(86) PCT No.: PCT/JP2019/048982
§ 371 (c)(1),
(2) Date: Feb. 26, 2021

(87) PCT Pub. No.: WO2020/202651
PCT Pub. Date: Oct. 8, 2020

(65) Prior Publication Data

US 2021/0317632 A1 Oct. 14, 2021

(30) Foreign Application Priority Data

Mar. 29, 2019 (JP) ..... 2019-067674

(51) Int. Cl.
*E02F 3/43* (2006.01)
*E02F 3/28* (2006.01)
(Continued)

(52) U.S. Cl.
CPC ..... *E02F 3/439* (2013.01); *E02F 3/283* (2013.01); *E02F 9/2285* (2013.01); *E02F 9/24* (2013.01); *E02F 9/265* (2013.01); *E02F 9/268* (2013.01)

(58) Field of Classification Search
CPC ... E02F 3/439; E02F 3/283; E02F 9/24; E02F 9/268; E02F 9/2285; E02F 9/265
See application file for complete search history.

(56) References Cited

U.S. PATENT DOCUMENTS 9,593,469 B2 * 3/2017 Taylor ..... E02F 9/2025
2013/0045072 A1 * 2/2013 Jensen ..... E02F 9/2087 701/50

(Continued)

FOREIGN PATENT DOCUMENTS

CN 105804148 A * 7/2016 ..... E02F 9/24
JP 06-193097 A 7/1994

(Continued)

OTHER PUBLICATIONS

CN-105804148-A_English Translation (Year: 2016).*
International Search Report of PCT/JP2019/048982 dated Feb. 4, 2020.

*Primary Examiner* — Rachid Bendidi
*Assistant Examiner* — Dana F Artimez
(74) *Attorney, Agent, or Firm* — Mattingly & Malur, PC

(57) ABSTRACT

Provided is a wheel loader capable of reducing erroneous determination of rear wheel lifting. The wheel loader 1 includes a controller 5 for determining a rear wheel lifting state where rear wheels 11B are lifted upwardly. The controller 5 is configured to, when a temporal change rate α of a bucket operation angle becomes a temporal change rate of a bucket operation angle necessary for a tilt operation of a bucket 23 during an excavation operation and a temporal change rate β of a vehicle body inclination angle estimated by the controller 5 becomes a temporal change rate of an obliquely upward inclination state of a rear vehicle body with respect to a front vehicle body, turn on a correlation flag indicating a correlation between an operation state of the (Continued)

bucket 23 and an inclination state of a vehicle body to determine a rear wheel lifting.

7 Claims, 11 Drawing Sheets

(51) Int. Cl.

| | |
|---|---|
| ***E02F 9/22*** | (2006.01) |
| ***E02F 9/24*** | (2006.01) |
| ***E02F 9/26*** | (2006.01) |

(56) References Cited

U.S. PATENT DOCUMENTS

| | | | | |
|---|---|---|---|---|
| 2015/0176253 | A1* | 6/2015 | Taylor ..... | E02F 9/265<br>701/33.9 |
| 2015/0275469 | A1 | 10/2015 | Fredrickson et al. | |

FOREIGN PATENT DOCUMENTS

| | | | |
|---|---|---|---|
| JP | 11-171492 | A | 6/1999 |
| JP | 2011-163048 | A | 8/2011 |
| JP | 2013-238097 | A | 11/2013 |

* cited by examiner

WHEEL LOADER

TECHNICAL FIELD

The present invention relates to a wheel loader which performs loading work by excavating such as earth and sand and minerals and loading them into such as a dump truck.

BACKGROUND ART

In the case of work vehicles such as a wheel loader and a hydraulic excavator, there is a possibility that a vehicle body may tilt or overturn due to excavation reaction force of a working device at the time of excavating an object to be excavated such as earth and sand and minerals with the working device attached to a front portion of the vehicle body.

Especially, in the case of the wheel loader, if the object to be excavated is robust or heavy, rear wheels may be lifted in the upward direction by the excavation reaction force of the working device. When the wheel loader 1 performs an operation in a state of rear wheel lifting (hereinafter, referred to as "rear wheel lifting operation"), stability of the vehicle body is impaired. Furthermore, when the rear wheels lifted in the upward direction return to the original position, since a large impact is applied to the vehicle body due to collision between the rear wheels and the ground, there is a possibility that the life of the vehicle body is adversely affected.

Accordingly, the work vehicle has been configured to detect that the vehicle body is in a state of being about to tilt or overturn so as to ensure the stability of the vehicle body. For example, a hydraulic excavator described in Patent Literature 1 is configured to set a predetermined threshold in accordance with an inclination angle of the hydraulic excavator, a revolving position of the hydraulic excavator, and posture of an excavation attachment, and include an overturn prevention device for issuing a warning that a sign of overturning of the vehicle body appears to an operator when change in the inclination angle of the hydraulic excavator with respect to the horizontal plane (inclination angular velocity) is equal to or more than the predetermined threshold so as to prevent in advance the vehicle body from overturning.

CITATION LIST

Patent Literature

Patent Literature 1: JP-A-2013-238097

SUMMARY OF INVENTION

Technical Problem

It can be considered to apply the overturn prevention device according to Patent Literature 1 to the wheel loader to determine the rear wheel lifting, and in such a case, a predetermined threshold which serves as a criterion for determining the rear wheel lifting is set in accordance with the inclination angle of the vehicle body and the posture of the bucket. When the bucket is tilted at the same time as the wheel loader is about to travel on a downward slope, a condition of the inclination angle of the vehicle body and the posture of the bucket, which is the same as the condition for determining the rear wheel lifting operation, is satisfied apparently. Accordingly, when the wheel loader travels on a downward slope, erroneous determination of the rear wheel lifting is easily to occur.

It is therefore an object of the present invention to provide a wheel loader capable of reducing erroneous determination of rear wheel lifting.

Solution to Problem

In order to achieve the object above, the present invention provides a wheel loader comprising: a vehicle body formed by a front vehicle body and a rear vehicle body; front wheels provided on the front vehicle body and rear wheels provided on the rear vehicle body; and a working device attached to the front vehicle body and having a bucket used in an excavation operation, wherein the wheel loader further comprises: an operation state sensor configured to detect an operation state of the bucket; an inclination state sensor configured to detect an inclination state of the vehicle body; a controller configured to determine a rear wheel lifting state in which the rear wheels are lifted in an upward direction by excavation reaction force of the working device, and the controller is further configured to: in cases where a temporal change rate of the operation state of the bucket detected by the operation state sensor is a first temporal change rate which is a temporal change rate of the operation state of the bucket necessary for a tilt operation of the bucket during the excavation operation, and where a temporal change rate of the inclination state of the vehicle body detected by the inclination state sensor is a second temporal change rate which is a temporal change rate of an obliquely upward inclination state of the rear vehicle body with respect to the front vehicle body, turn on a correlation flag indicating a correlation between the operation state of the bucket and the inclination state of the vehicle body to determine the rear wheel lifting state.

Advantageous Effects of Invention

According to the present invention, it is possible to reduce erroneous determination of rear wheel lifting. The problems, configurations, and effects other than those described above will be clarified by explanation of the embodiments below.

DESCRIPTION OF EMBODIMENTS

Hereinafter, a configuration of a wheel loader according to an embodiment of the present invention will be described with reference to FIG. 1 to FIG. 7.

<Overall Configuration of Wheel Loader 1>

Firstly, an overall configuration of a wheel loader 1 according to the embodiment of the present invention will be described with reference to FIG. 1.

Figure 1:
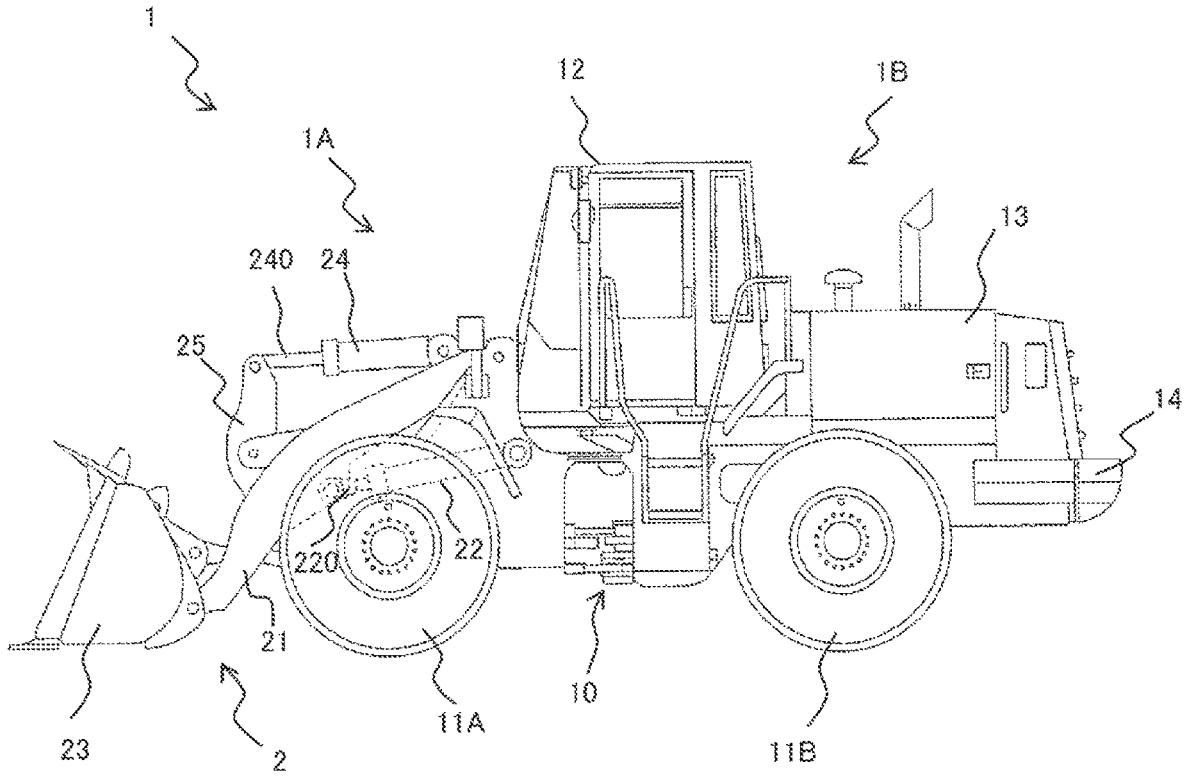
FIG. 1 is a side view illustrating appearance of a wheel loader according to an embodiment of the present invention.

FIG. 1 is a side view illustrating appearance of the wheel loader 1 according to the embodiment of the present invention.

The wheel loader 1 is an articulated type work vehicle which is swiveled on a central portion of a vehicle body and steered thereby. Specifically, a front frame 1A that is a front part of the vehicle body and a rear frame 1B that is a rear part of the vehicle body are connected to each other by a center joint 10 to swivel in the left and right direction so that the front frame 1A is bent in the left and right direction with respect to the rear frame 1B.

The wheel loader 1 includes four wheels on its entire vehicle body. A pair of left and right front wheels 11A is provided on the front frame 1A, and a pair of left and right rear wheels 11B is provided on the rear frame 1B. FIG. 1 illustrates, among the four wheels, only the left front wheel 11A of the pair of left and right front wheels 11A and the left rear wheel 11B of the pair of left and right rear wheels 11B.

The wheel loader 1 is configured to perform loading work by excavating such as earth and sand and minerals in a strip mine, etc., and loading them into such as a dump truck with a working device 2 attached to the front frame 1A.

The working device 2 includes a lift arm 21 attached to the front frame 1A, two lift arm cylinders 22 configured to expand and contract to rotate the lift arm 21 in the vertical direction with respect to the front frame 1A, a bucket 23 attached to a front end portion of the lift arm 21, a bucket cylinder 24 configured to expand and contract to rotate the bucket 23 in the vertical direction with respect to the lift arm 21, a bell crank 25 that is rotatably connected to the lift arm 21 and constitutes a link mechanism between the bucket 23 and the bucket cylinder 24, and a plurality of pipelines (not illustrated) for leading pressure oil to the two lift arm cylinders 22 and the bucket cylinder 24.

Each of the two lift arm cylinders 22 and the bucket cylinder 24 is one of the aspects of a hydraulic cylinder that drives the working device 2. FIG. 1 illustrates, among the two lift arm cylinders 22 arranged in the lateral direction of the vehicle body, only the lift arm cylinder 22 disposed on the left side by a dashed line.

When a rod 220 of each of the two lift arm cylinders 22 expands, the lift arm 21 is rotated in the upward direction. When the rod 220 of each of the two lift arm cylinders 22 contracts, the lift arm 21 is rotated in the downward direction.

When a rod 240 of the bucket cylinder 24 expands, the bucket 23 is tilted (rotated in the upward direction with respect to the lift arm 21). When the rod 240 of the bucket cylinder 24 contracts, the bucket cylinder 24 is dumped (rotated in the downward direction with respect to the lift arm 21). In this connection, the bucket 23 can be replaced with various attachments such as a blade, and in addition to an excavation operation using the bucket 23, various operations such as a dozing operation and a snow removing operation can be performed.

The rear frame 1B is further provided with an operator's cab 12 to be boarded by an operator, a mechanical room 13 that accommodates devices necessary to drive the wheel loader 1, and a counterweight 14 for maintaining balance between the vehicle body and the working device 2 to prevent the vehicle body from tilting. In the rear frame 1B, the operator's cab 12 is disposed on the front, the counterweight 14 is disposed on the rear, and the mechanical room 13 is disposed between the operator's cab and the counterweight 14, respectively.

<Drive System of Working Device 2>

Next, a drive system of the working device 2 will be described with reference to FIG. 2.

Figure 2:
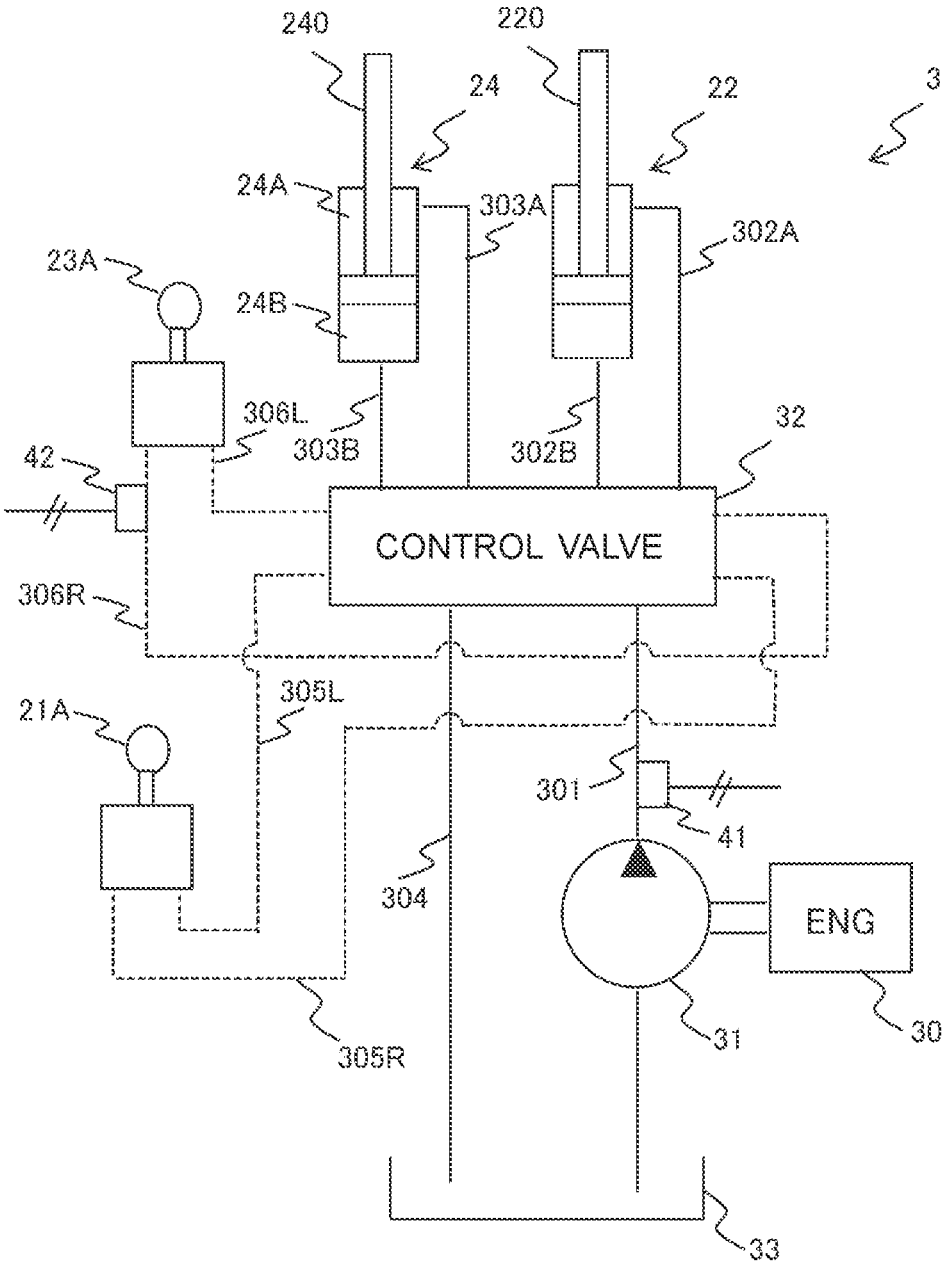
FIG. 2 is a hydraulic circuit diagram according to drive of a working device.

FIG. 2 is a hydraulic circuit diagram according to drive of the working device 2.

The wheel loader 1 includes a working device hydraulic circuit 3 for driving the working device 2. The working device hydraulic circuit 3 is provided with a hydraulic pump 31 driven by an engine 30, the lift arm cylinders 22, the bucket cylinder 24, a control valve 32 for controlling a flow (direction and flow rate) of hydraulic oil discharged from the hydraulic pump 31 and flowing into each of the lift arm cylinders 22 and the bucket cylinder 24, and a hydraulic oil tank 33 for storing the hydraulic oil. In this connection, FIG. 2 illustrates only one of the two lift arm cylinders 22 for the purpose of simplifying the configuration.

The hydraulic pump 31 supplies hydraulic oil sucked from the hydraulic oil tank 33 to each of the lift arm cylinders 22 and the bucket cylinder 24. In FIG. 2, the hydraulic pump 31 is a fixed displacement hydraulic pump. Meanwhile, the hydraulic pump 31 is not limited thereto, and it may be a variable displacement hydraulic pump.

The discharge pressure of the hydraulic pump 31 is detected by a discharge pressure sensor 41 provided on a discharge conduit 301 connected to the discharge side of the hydraulic pump 31. The discharge pressure detected by the discharge pressure sensor 41 varies depending on an operation state of the working device 2.

The control valve 32 is provided between the hydraulic pump 31 and the lift arm cylinders 22 and the bucket cylinder 24. Specifically, the control valve 32 is connected to the hydraulic pump 31 via the discharge conduit 301, to the lift arm cylinders 22 via a pair of lift arm side connecting conduits 302A, 302B, and to the bucket cylinder 24 via a pair of bucket side connecting conduits 303A, 303B, respectively. In addition, the control valve 32 is connected to the hydraulic oil tank 33 via a discharge conduit 304.

The lift arm cylinders 22 are driven based on an operation of a lift arm operation lever 21A serving as a lift arm operation device for operating the lift arm 21. The bucket cylinder 24 is driven based on an operation of a bucket operation lever 23A serving as a bucket operation device for operating the bucket 23. Each of the lift arm operation lever 21A and the bucket operation lever 23A is a hydraulic pilot type operation lever, and is provided in the operator's cab 12 (see FIG. 1).

When the operator operates the lift arm operation lever 21A, the pilot pressure proportional to an operation amount thereof is generated as an operation signal. The generated pilot pressure is guided to a pair of pilot conduits 305L, 305R, acts on left and right pressure receiving chambers of the control valve 32, and internal spool of the control valve 32 strokes in accordance with the pilot pressure. Thus, the hydraulic oil discharged from the hydraulic pump 31 flows into the lift arm cylinders 22 in accordance with a direction and a flow rate corresponding to the operation of the lift arm operation lever 21A.

Similarly, when the operator operates the bucket operation lever 23A, the pilot pressure proportional to an operation amount thereof is guided to a pair of pilot conduits 306L, 306R, acts on the left and right pressure receiving chambers of the control valve 32, and internal spool of the control valve 32 strokes in accordance with the pilot pressure. Thus, the hydraulic oil discharged from the hydraulic pump 31 flows into the bucket cylinder 24 in accordance with a direction and a flow rate corresponding to the operation of the bucket operation lever 23A.

For example, at the time of performing the excavation operation, the wheel loader 1 tilts the bucket 23 after making it thrust into an object to be excavated. When the operator operates the bucket operation lever 23A in a tilt direction, the hydraulic oil discharged from the hydraulic pump 31 and passing through the discharge conduit 301 is guided to one of the bucket side connecting conduits 303B via the control valve 32, and flows into a bottom chamber 24B of the bucket cylinder 24. On the one hand, the hydraulic oil in a rod chamber 24A of the bucket cylinder 24 flows out to the other one of the bucket side connecting conduits 303A, is guided to the discharge conduit 304 via the control valve 32, and discharged to the hydraulic oil tank 33. Thus, the rod 240 of the bucket cylinder 24 is expanded and the bucket 23 is tilted.

In the present embodiment, the pilot pressure sensor 42 as an operation amount sensor for detecting an operation amount of the bucket operation lever 23A is provided on the pair of pilot conduits 306L, 306R. The pilot pressure sensor 42 is also one of the aspects of an operation state sensor for detecting an operation state of the bucket 23. In the present embodiment, since the bucket operation lever 23A is a hydraulic pilot type operation lever, the pilot pressure sensor 42 detects the operation amount of the bucket operation lever 23A. Meanwhile, the bucket operation lever 23A may be an electric operation lever, and in such a case, the operation amount of the bucket operation lever 23A can be detected based on a current value output from the bucket operation lever 23A.

<Rear Wheel Lifting Operation>

Next, a rear wheel lifting operation of the wheel loader 1 will be described with reference to FIG. 3 to FIG. 5.

Figure 3A:
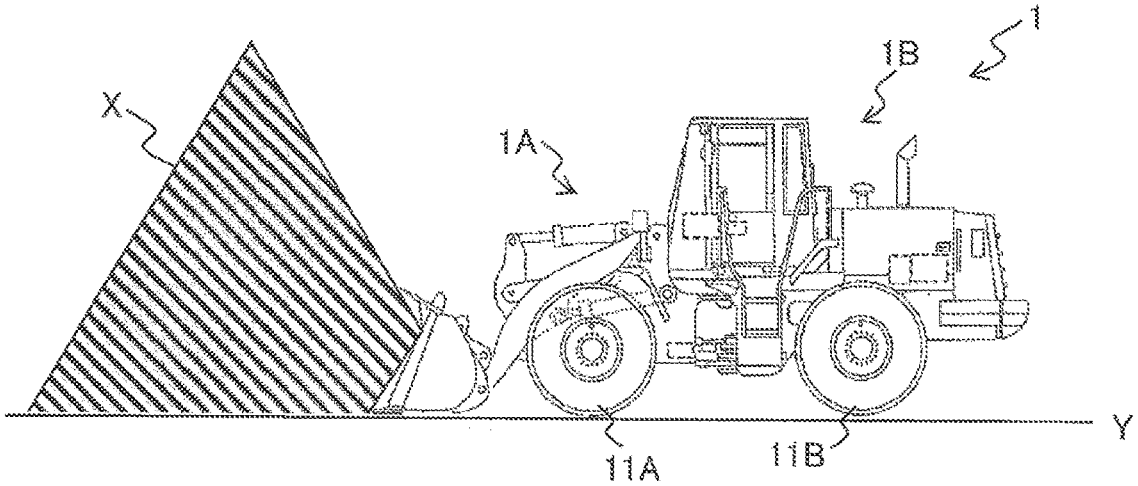
FIG. 3 explains a rear wheel lifting operation of a wheel loader.
Figure 3B:
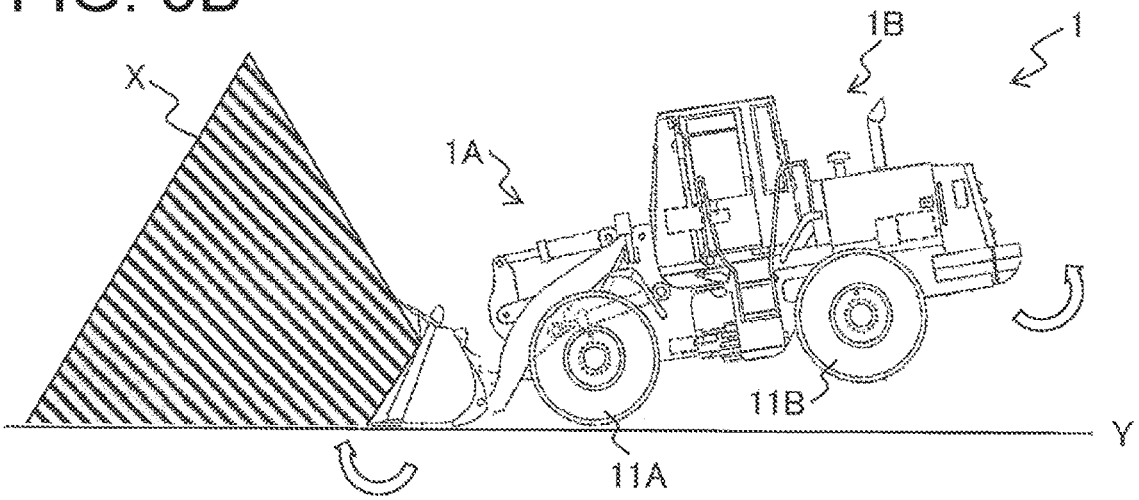
Figure 3C:
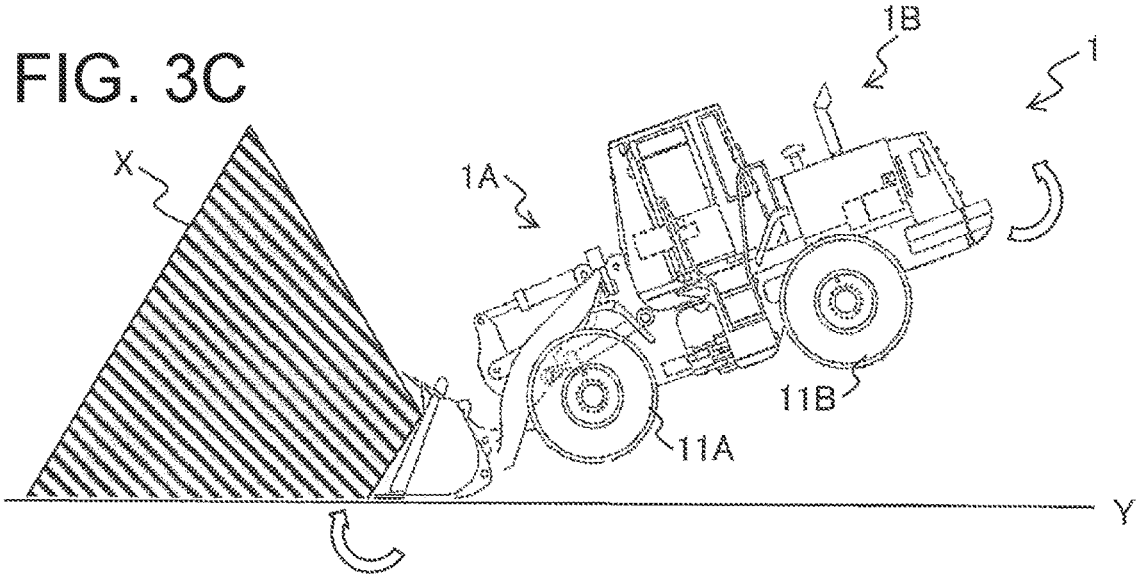
Figure 4:
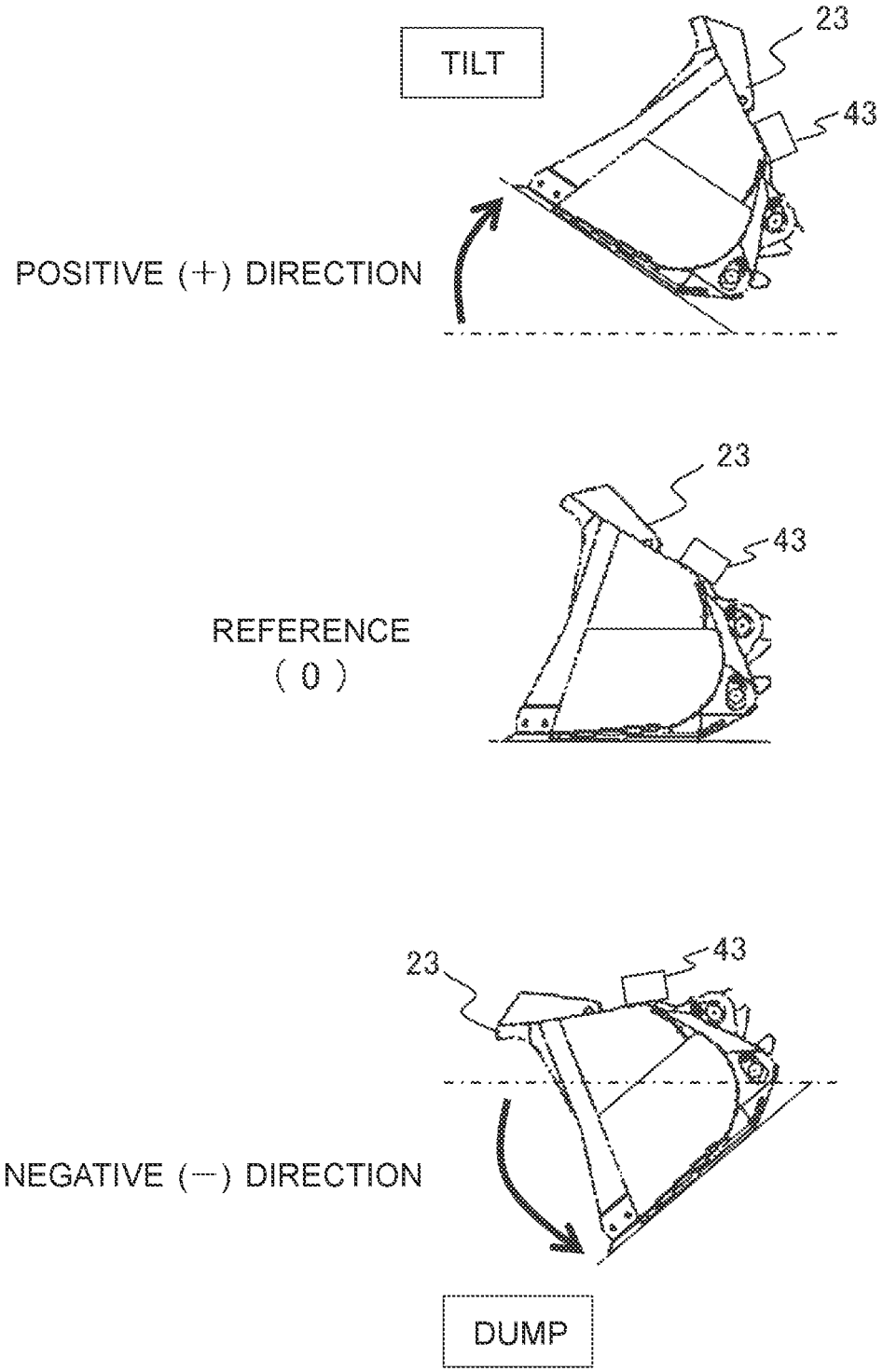
FIG. 4 explains how to provide a sign to an operation direction of a bucket.

FIG. 3 explains the rear wheel lifting operation of the wheel loader 1. FIG. 4 explains how to provide a sign to an operation direction of the bucket 23. FIG. 5 explains how to provide a sign to an inclination direction of the vehicle body.

When the wheel loader 1 performs the excavation operation, if the object to be excavated is robust or heavy, there is a case where the rear wheels 11B are lifted in the upward direction by the reaction force of the excavation force (drive force for tilting) of the bucket 23.

Specifically, as illustrated in FIG. 3(*a*), firstly, the wheel loader 1 makes the bucket 23 thrust into a pile X formed by earth and sand, mineral, etc., which is an object to be excavated. Next, as illustrated in FIG. 3(*b*), the wheel loader 1 tilts the bucket 23 in a state of being thrust into the pile X. At this time, when the excavation force of the bucket 23 is made to increase to correspond to the hardness and weight of the pile X, the rear wheels 11B move away from a ground Y due to the excavation reaction force of the bucket 23. Then, as the bucket 23 is further tilted, the reaction force also increases in response to the excavation force of the bucket 23. Accordingly, as illustrated in FIG. 3(*c*), the rear wheels 11B are lifted above the ground Y, which makes a state where the rear side of the vehicle body (rear part of the vehicle body) is inclined obliquely in the upward direction with respect to the front side thereof (front part of the vehicle body).

In this connection, FIG. 3(*c*) illustrates a state where not only the rear wheels 11B but also the front wheels 11A are lifted from the ground Y. In the state above, at least the rear wheels 11B are lifted by the excavation reaction force of the bucket 23. Therefore, each of the states illustrated in FIG. 3(*b*) and FIG. 3(*c*) is a state of rear wheel lifting. An operation in which the wheel loader 1 performs excavation in the state of rear wheel lifting is referred to as "rear wheel lifting operation".

The rear wheel lifting operation is performed in a state where the vehicle body is unstable. In addition, since a large impact is applied to the vehicle body due to collision of the rear wheels 11B with the ground Y when the rear wheels 11B lifting above the ground Y return to the original position, there is a possibility that the life of the vehicle body is adversely affected. Accordingly, in the present invention, the wheel loader 1 is configured that the controller 5 which will be described later (see FIG. 6) accurately determines the rear wheel lifting state.

In the rear wheel lifting state, the bucket 23 is operated in the upward direction and the rear side of the vehicle body is inclined obliquely in the upward direction with respect to the front side thereof. With regard to an operation direction of the bucket 23, for example as illustrated in FIG. 4, a state where the bucket 23 is not operated is defined as a reference (zero), a tilt direction in which the front end portion is rotated in the upward direction around the rear end portion of the bucket 23 is defined as a positive direction, and a dump direction in which the front end portion is rotated in the downward direction around the rear end portion of the bucket 23 is defined as a negative direction.

Figure 5:
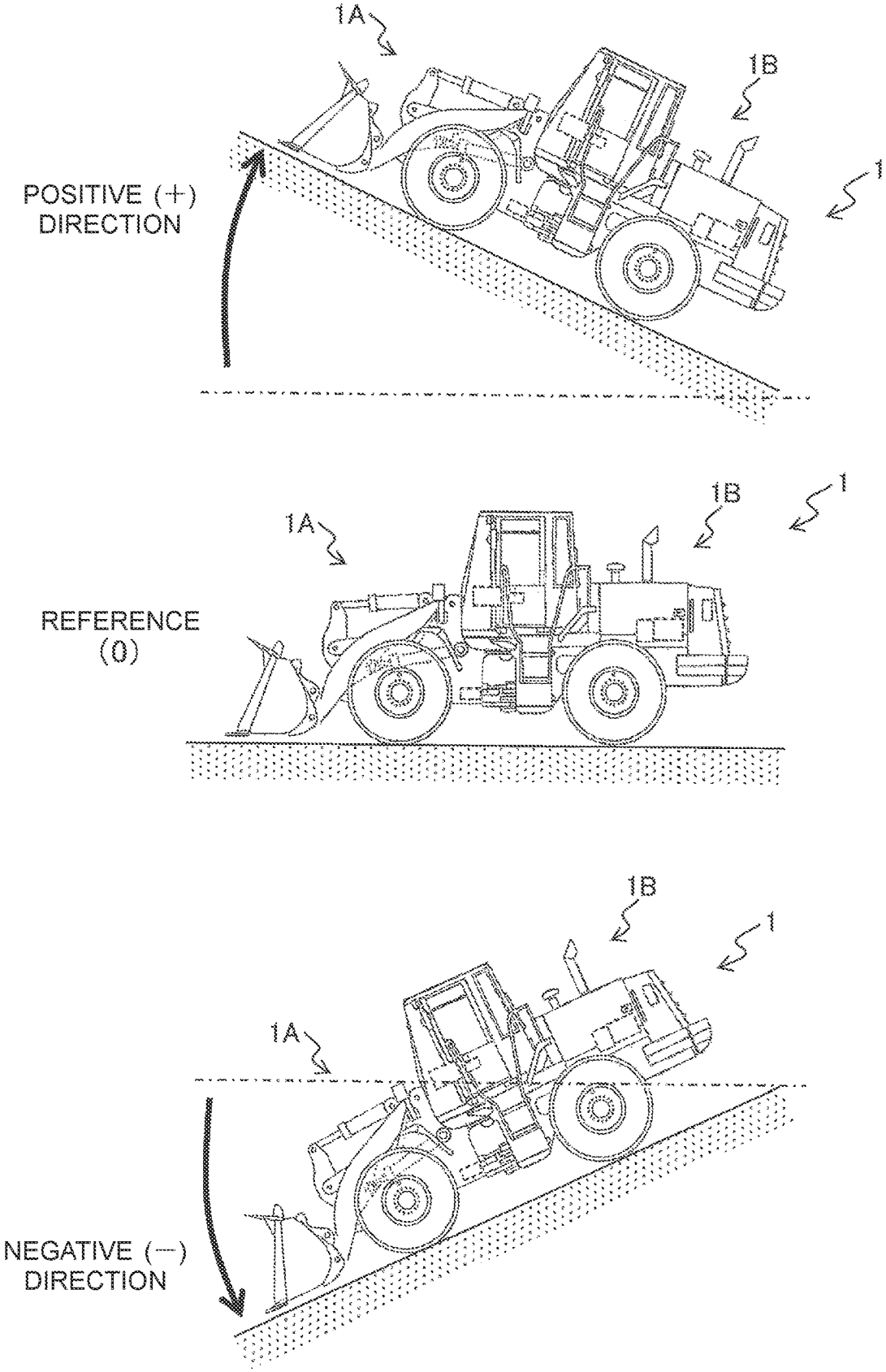
FIG. 5 explains how to provide a sign to an inclination direction of a vehicle body.

When an inclination direction of the vehicle body is provided with a sign in the same manner as the case of the operation direction of the bucket 23, as illustrated in FIG. 5, a state where the vehicle body is on the plane is defined as a reference (zero), a state where the front end of the vehicle body is inclined in the upward direction around the rear end thereof, in other words, a state where the front side of the vehicle body is inclined obliquely in the upward direction with respect to the rear side thereof is defined as a positive direction, and a state where the front end of the vehicle body is inclined in the downward direction around the rear end portion of the vehicle body, in other words, a state where the rear side of the vehicle body is inclined obliquely in the upward direction with respect to the front side thereof is defined as a negative direction.

Accordingly, in the rear wheel lifting state, the operation direction of the bucket 23 is a positive direction and the inclination direction of the vehicle body is a negative direction, which shows that the sign of the operation direction of the bucket 23 is opposite to the sign of the inclination direction of the vehicle body. Meanwhile, a way to provide signs to the operation directions of the bucket 23 and the inclination directions of the vehicle body is not limited to the one illustrated in FIG. 4 and FIG. 5.

In the present embodiment, the operation state of the bucket 23 is detected by a bucket IMU 43 as a bucket angle sensor for detecting an operation angle Φ of the bucket 23 (hereinafter, simply referred to as "bucket operation angle Φ"). That is, the bucket IMU 43 is one of the aspects of the operation state sensor for detecting the operation state of the bucket 23. The bucket IMU 43 is an inertial measuring unit for obtaining three-dimensional angular velocity and acceleration by a three-axis gyro and three-direction accelerometer, and configured to detect the bucket operation angle Φ based on the angular velocity and the acceleration of the bucket 23. Meanwhile, as the bucket angle sensor, a mechanical angle sensor configured to directly measure the bucket operation angle Φ may be used.

Furthermore, the operation state sensor is not limited to the bucket angle sensor such as the bucket IMU 43 and the above-mentioned pilot pressure sensor 42. It may be a sensor configured to detect cylinder length of the bucket cylinder 24 (length of expansion/contraction of the rod 240) or a sensor configured to detect the pressure applied to the bucket cylinder 24. Still further, the operation state of the bucket 23 may be detected by combining these sensors.

When the bucket 23 is tilted, the bucket operation angle Φ detected by the bucket IMU 43 has a positive value, and when the bucket 23 is dumped, the bucket operation angle Φ detected by the bucket IMU 43 has a negative value.

In the present embodiment, an inclination state of the vehicle body with respect to the horizontal direction is estimated at any time, as an inclination angle θ of the vehicle body with respect to the horizontal direction (hereinafter, simply referred to as the "vehicle body inclination angle θ"), by the controller 5 which will be described later based on the IMU angular velocity and the IMU acceleration detected by a vehicle body IMU 44 and vehicle speed V detected by a vehicle speed sensor 45. That is, each of the vehicle body IMU 44 and the vehicle speed sensor 45 is an inclination angle sensor for detecting the vehicle body inclination angle θ, and is one of the aspects of an inclination state sensor for detecting an inclination state of the vehicle body with respect to the horizontal direction. The vehicle body IMU 44 is an inertial measuring unit similar to the bucket IMU 43. The vehicle speed sensor 45 is configured to detect the vehicle speed V by measuring rotation speed of the wheels 11A and 11B.

In this connection, the inclination state sensor is not necessarily the inclination angle sensor using the vehicle body IMU 44 and the vehicle speed sensor 45. For example, the inclination state of the vehicle body with respect to the horizontal direction may be detected based on the load (pressure) applied to the front wheels 11A and the rear wheels 11B.

When the front side of the vehicle body is inclined obliquely in the upward direction with respect to the horizontal direction, the vehicle body inclination angle θ estimated based on the vehicle body IMU 44 and the vehicle speed sensor 45 has a positive value, and when the rear side of the vehicle body is inclined obliquely in the upward direction with respect to the horizontal direction, the vehicle body inclination angle θ estimated based on the vehicle body IMU 44 and the vehicle speed sensor 45 has a negative value.

<Configuration of Controller 5>

Next, the configuration of the controller 5 will be described with reference to FIG. 6.

Figure 6:
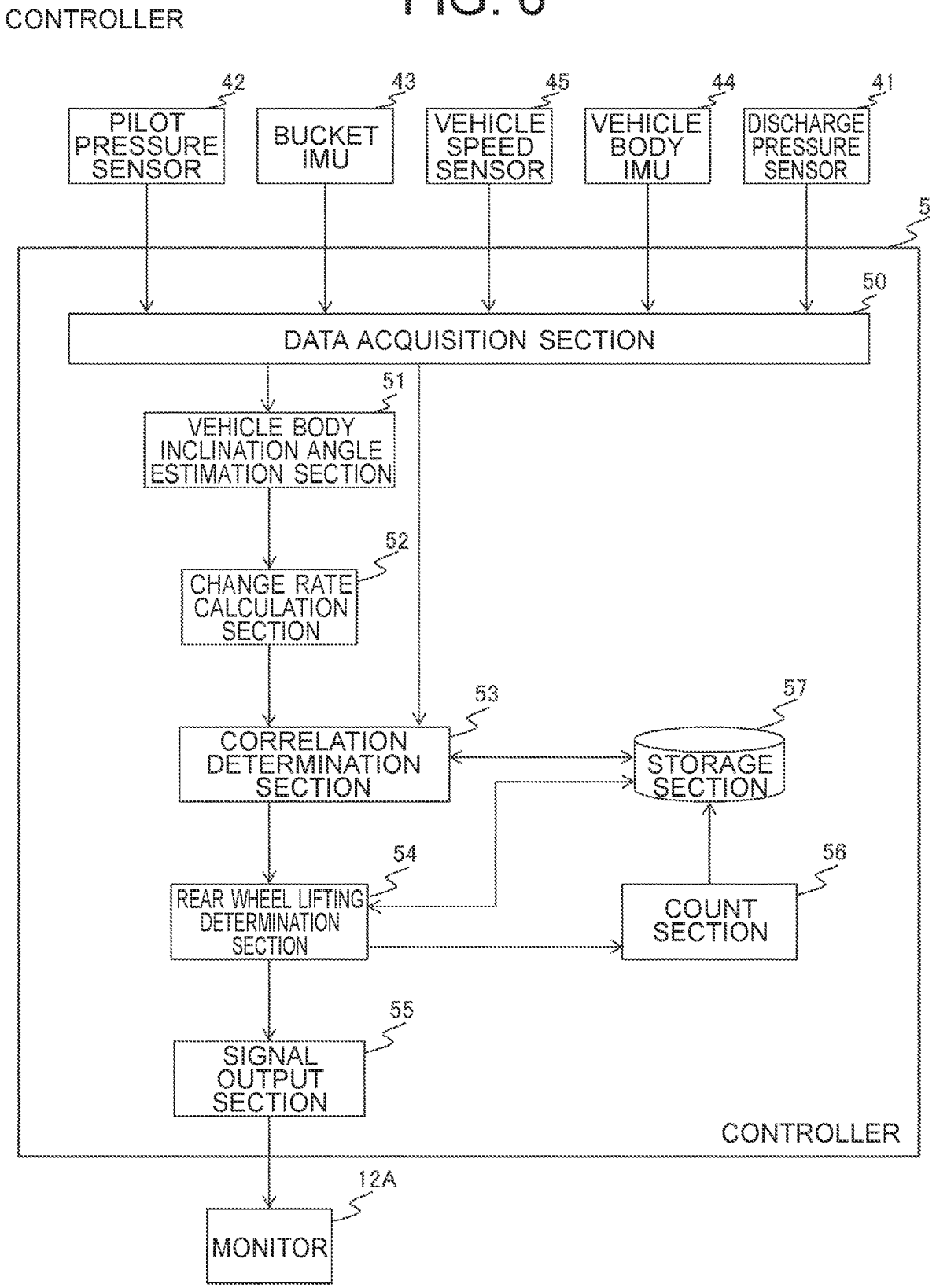
FIG. 6 is a functional block diagram illustrating functions of a controller.

FIG. 6 is a functional block diagram illustrating functions of the controller 5.

The controller 5 is configured such that a CPU, a RAM, a ROM, an HDD, an input I/F, and an output I/F are connected to each other via a bus. Various sensors such as the discharge pressure sensor 41, the pilot pressure sensor 42, the bucket IMU 43, the vehicle body IMU 44, and the vehicle speed sensor 45 configured to detect the vehicle speed are connected to the input I/F, and a monitor 12A, etc. provided in the operator's cab 12 (see FIG. 1) is connected to the output I/F. The monitor 12A is one of the aspects of a notification device for notifying the operator of the rear wheel lifting state which has been determined by the controller 5.

In this hardware configuration, the CPU reads out a control program (software) stored in a recording medium such as the ROM, the HDD, or an optical disk, expands it on the RAM, and executes the expanded control program. Thereby, the control program and the hardware are operated in cooperation, which realizes the functions of the controller 5.

In the present embodiment, the controller 5 is described by a combination of software and hardware. Meanwhile, the present invention is not limited thereto, but an integrated circuit that realizes the functions of a control program executed on the side of the wheel loader 1 may be used.

The controller 5 includes a data acquisition section 50, a vehicle body inclination angle estimation section 51, a change rate calculation section 52, a correlation determination section 53, a rear wheel lifting determination section 54, a signal output section 55, a count section 56, and a storage section 57.

The data acquisition section 50 is configured to acquire data relating to the bucket operation angle Φ detected by the bucket IMU 43, the IMU angular velocity and the IMU acceleration detected by the vehicle body IMU 44, and the vehicle speed V detected by the vehicle speed sensor 45, respectively.

The vehicle body inclination angle estimation section 51 is configured to estimate the vehicle body inclination angle θ at any time based on the IMU angular velocity, the IMU acceleration, and the vehicle speed V acquired by the data acquisition section 50.

The change rate calculation section 52 is configured to calculate a temporal change rate α of the bucket operation angle based on the bucket operation angle Φ acquired by the data acquisition section 50, and calculate a temporal change rate β of the vehicle body inclination angle based on the vehicle body inclination angle θ estimated by the vehicle body inclination angle estimation section 51.

The correlation determination section 53 is configured to determine whether the temporal change rate α of the bucket operation angle calculated by the change rate calculation section 52 is equal to or greater than a first change rate threshold αth. The "first change rate threshold αth" is a temporal change rate of the tilt angle of the bucket 23 necessary for the start of the excavation operation. In the present embodiment, the first change rate threshold αth has a positive value (αth>0).

Furthermore, the correlation determination section 53 determines whether the temporal change rate β of the vehicle body inclination angle calculated by the change rate calculation section 52 is equal to or less than a second change rate threshold βth. The "second change rate threshold βth" is a temporal change rate of the vehicle body inclination angle necessary for the start of obliquely upward inclination of the rear part of the vehicle body with respect to the front part thereof. In the present embodiment, the second change rate threshold βth has a negative value (βth<0). That is, the sign (negative) of the second change rate threshold βth is different from the sign (positive) of the first change rate threshold αth.

Then, the correlation determination section 53 turns on or off a correlation flag indicating a correlation between the operation state of the bucket 23 and the inclination state of the vehicle body in accordance with a determination result of the temporal change rate $\alpha$ of the bucket operation angle and the temporal change rate $\beta$ of the vehicle body inclination angle.

More specifically, when determining that the temporal change rate $\alpha$ of the bucket operation angle is equal to or more than the first change rate threshold $\alpha th$ ($\alpha \geq \alpha th$) and the temporal change rate $\beta$ of the vehicle body inclination angle is equal to or less than the second change rate threshold $\beta th$ ($\beta \leq \beta th$), the correlation determination section 53 turns on the correlation flag (correlation flag=1).

That is, when the temporal change rate $\alpha$ of the bucket operation angle calculated by the change rate calculation section 52 becomes the temporal change rate (first temporal change rate) of the bucket operation angle necessary for the tilt operation of the bucket 23 during the excavation operation, and when the temporal change rate $\beta$ of the vehicle body inclination angle calculated by the change rate calculation section 52 becomes the temporal change rate (second temporal change rate) of the obliquely upward inclination angle of the rear part of the vehicle body with respect to the front part thereof, the correlation determination section 53 turns on the correlation flag.

In the present embodiment, since the tilt direction of the bucket 23 is defined as the positive direction, the case where the temporal change rate $\alpha$ of the bucket operation angle is equal to or more than the first change rate threshold $\alpha th$ ($\alpha \geq \alpha th$) corresponds to the first temporal change rate. Furthermore, since the direction in which the rear part of the vehicle body inclines obliquely in the upward direction with respect to the front part of the vehicle body is defined as the negative direction, the case where the temporal change rate $\beta$ of the vehicle body inclination angle is equal to or less than the second change rate threshold $\beta th$ ($\beta \leq \beta th$) corresponds to the second temporal change rate.

As mentioned above, there are various ways to provide signs to the tilt directions of the bucket 23 and the obliquely upward inclination directions of the rear part of the vehicle body with respect to the front part thereof. For example, when the tilt direction of the bucket 23 is defined as the negative direction and the obliquely upward inclination direction of the rear part of the vehicle body with respect to the front part thereof is defined as the positive direction, a case where the temporal change rate $\alpha$ of the bucket operation angle is equal to or less than the first temporal change rate threshold $\alpha th$ ($\alpha \leq \alpha th$) corresponds to the first temporal change rate, and a case where the temporal change rate $\beta$ of the vehicle body inclination angle is equal to or more than the second change rate threshold $\beta th$ ($\beta \geq \beta th$) corresponds to the second temporal change rate.

Furthermore, for example, when both the tilt direction of the bucket 23 and the obliquely upward inclination direction of the rear part of the vehicle body with respect to the front part thereof are defined as the positive directions, a case where the temporal change rate $\alpha$ of the bucket operation angle is equal to or more than the first temporal change rate threshold $\alpha th$ ($\alpha \geq \alpha th$) corresponds to the first temporal change rate, and a case where the temporal change rate $\beta$ of the vehicle body inclination angle is equal to more than the second temporal change rate threshold $\beta th$ ($\beta \geq \beta th$) corresponds to the second temporal change rate.

In this way, depending on the way to provide signs to the tilt direction of the bucket 23 and the obliquely upward inclination direction of the rear part of the vehicle body with respect to the front part thereof, a large/small relationship between the temporal change rate $\alpha$ of the bucket operation angle and the first change rate threshold $\alpha th$ and that between the temporal change rate $\beta$ of the vehicle body inclination angle and the second change rate threshold $\beta th$ are varied. Accordingly, the large/small relationship therebetween is not limited to the one described in the present embodiment.

The correlation determination section 53 is also configured to, when determining that the temporal change rate $\alpha$ of the bucket operation angle is less than the first change rate threshold $\alpha th$ ($\alpha < \alpha th$) or the temporal change rate $\beta$ of the vehicle body inclination angle is more than the second change rate threshold $\beta th$ ($\beta > \beta th$), turn off the correlation flag (correlation flag=0).

When the correlation determination section 53 turns on the correlation flag, the rear wheel lifting determination section 54 turns on a rear wheel lifting flag to determine a rear wheel lifting state (rear wheel lifting flag=1). In the present embodiment, when a state where the correlation flag is turned on continues for equal to or more than a predetermined set time T, the rear wheel lifting determination section 54 turns on the rear wheel lifting flag to determine the rear wheel lifting state (rear wheel lifting flag=1). With this configuration, it is possible to prevent erroneous determination of the rear wheel lifting which may occur when a condition indicating the rear wheel lifting in an operation other than the rear wheel lifting operation is satisfied, for example, when the bucket 23 is tilted at the same time as the wheel loader 1 is traveling on a downward slope.

In this connection, even when the state where the correlation flag is turned on does not continue for equal to or more than the predetermined set time T and the correlation flag is turned off, in the case where the correlation determination section 53 turned on the rear wheel lifting flag at the previous time (previous rear wheel lifting flag=1) and the vehicle body inclination angle $\theta$ is equal to or less than an inclination angle threshold $\theta th$ ($\theta \leq \theta th$), the rear wheel lifting determination section 54 turns on the rear wheel lifting flag to determine the rear wheel lifting state (rear wheel lifting flag=1). Here, the "inclination angle threshold $\theta th$" is the vehicle body inclination angle necessary for the start of the obliquely upward inclination of the rear part of the vehicle body with respect to the front part thereof, and in the present embodiment, it has a negative value.

Since both the bucket operation angle $\Phi$ and the vehicle body inclination angle $\theta$ continue to vary until the rear wheels 11B reach the lifting state, the correlation determination section 53 turns on the correlation flag. On the other hand, when the rear wheel lifting state is maintained, that is, during the rear wheel lifting operation, both the bucket operation angle $\Phi$ and the vehicle body inclination angle $\theta$ do not vary, and thus the correlation determination section 53 turns from on to off. In this case, the controller 5 prevents the rear wheel lifting determination section 54 from turning off the rear wheel lifting flag (rear wheel lifting flag=0), thereby avoiding erroneous determination that the rear wheel lifting state has been eliminated.

When the rear wheel lifting determination section 54 determines the rear wheel lifting state, the signal output section 55 outputs, to the monitor 12A, a command signal for notifying the rear wheel lifting state. By notifying the operator that the wheel loader 1 is in the rear wheel lifting state through the monitor 12A, it is possible to call attention to stop the rear wheel lifting operation.

The count section 56 is configured to count how many times the rear wheel lifting determining section 54 determines the rear wheel lifting state, and make the storage section 57 record the number of times. By leaving a log about the number of determination of the rear wheel lifting state in the controller 5, it is possible to manage proper use of the wheel loader 1.

The storage section 57 is a memory in which the first change rate threshold αth, the second change rate threshold βth, the predetermined set time T, and the inclination angle threshold θth are stored, respectively.

<Processing by Controller 5>

Next, a specific flow of processing executed by the controller 5 will be described with reference to FIG. 7.

Figure 7:
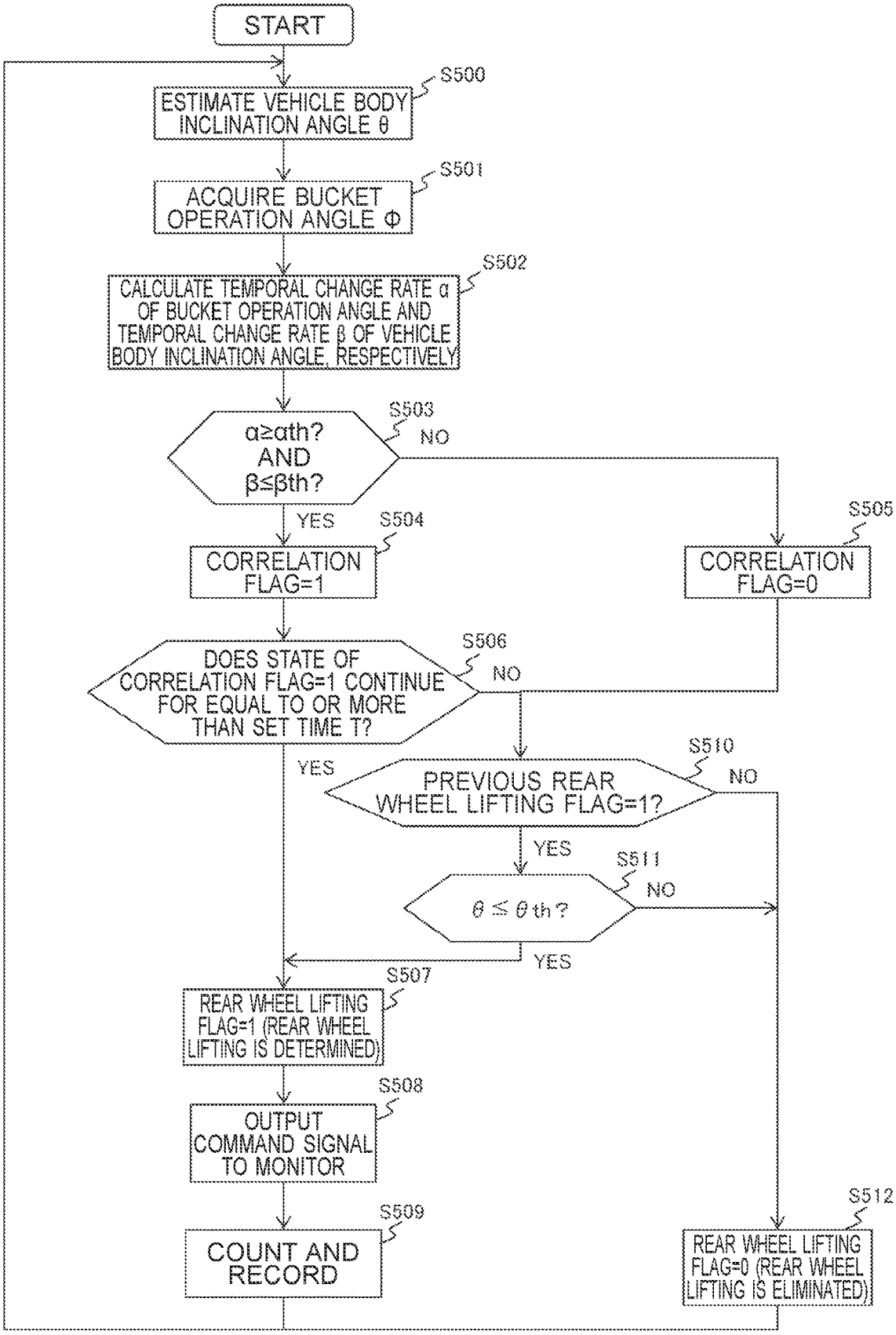
FIG. 7 illustrates a flowchart of processing executed by a controller.

FIG. 7 illustrates a flowchart of processing executed by the controller 5.

Firstly, the vehicle body inclination angle estimation section 51 estimates the vehicle body inclination angle θ at any time based on the IMU angular velocity, the IMU acceleration, and the vehicle speed V acquired by the data acquisition section 50 (step S500). The data acquisition section 50 acquires the bucket operation angle Φ detected by the bucket IMU 43 (step S501).

Next, the change rate calculation section 52 calculates the temporal change rate α of the bucket operation angle based on the bucket operation angle Φ acquired in step S501, and calculates the temporal change rate β of the vehicle body inclination angle based on the vehicle body inclination angle θ estimated in step S500 (step S502).

Then, the correlation determination section 53 determines whether the temporal change rate α of the bucket operation angle calculated in step S502 is equal to or more than the first change rate threshold αth and the temporal change rate β of the vehicle body inclination angle calculated in step S502 is equal to or less than the second change rate threshold βth (step S503).

When it is determined in step S503 that the temporal change rate α of the bucket operation angle is equal to or more than the first change rate threshold αth (α≥αth) and the temporal change rate β of the vehicle body inclination angle is equal to or less than the second change rate threshold βth (β≤βth) (step S503/YES), the correlation determination section 53 turns on the correlation flag (correlation flag=1) (step S504). On the other hand, when it is determined in step S503 that the temporal change rate α of the bucket operation angle is less than the first change rate threshold αth (α<αth) and the temporal change rate β of the vehicle body inclination angle is more than the second change rate threshold βth (β>βth) (step S503/NO), the correlation determination section 53 turns off the correlation flag (correlation flag=0) (step S505).

When the correlation flag is turned on in step S504, the rear wheel lifting determination section 54 determines whether the state where the correlation flag is turned on continues for equal to or more than the predetermined set time T (step S506). When it is determined in step S506 that the state where the correlation flag is turned on continues for equal to or more than the predetermined set time T (step S506/YES), the rear wheel lifting determination section 54 turns on the rear wheel lifting flag (rear wheel lifting flag=1) to determine the rear wheel lifting state (step S507).

Next, the signal output section 55 outputs a command signal for notifying the rear wheel lifting state to the monitor 12A (step S508). Next, the count section 56 counts the number of times of determination of the rear wheel lifting state, and stores the number thereof in the storage section 57 (step S509). Then, the controller 5 returns to step S501 and repeats the processing. In this connection, there is no limitation on an order between step S508 and step S509, and thus step S509 may be executed first, or step S508 and step S509 may be executed simultaneously.

When the state where the correlation flag is turned on does not continue for equal to or more than the predetermined set time T and the correlation flag is turned off in step S506 (step S506/NO), and when the correlation flag is turned off in step S505 (correlation flag=0), the rear wheel lifting determination section 54 determines whether the rear wheel lifting flag was turned on at the previous time (step S510).

When it is determined in step S510 that the correlation flag of the previous time was turned on (previous correlation flag=1) (step S510/YES), the rear wheel lifting determination section 54 determines whether the vehicle body inclination angle θ acquired in step S501 is equal to or less than the inclination angle threshold θth (step S511). In step S511, for example, the rear wheel lifting determination section 54 may make determination thereof based on an absolute value of the vehicle body inclination angle θ. In this case, the rear wheel lifting determination section 54 determines whether an absolute value of the vehicle body inclination angle |θ| is equal to or more than an absolute value of the inclination angle threshold |θth|.

When it is determined in step S511 that the vehicle body inclination angle θ is equal to or less than the inclination angle threshold θth (θ≤θth) (step S511/YES), the controller 5 proceeds to step S507 and turns on the rear wheel lifting flag (rear wheel lifting flag=1).

In both cases where it is determined in step S510 that the rear wheel lifting flag was turned off at the previous time (previous rear wheel lifting flag=0) (step S510/NO) and where it is determined in step S511 that the vehicle body inclination angle θ is equal to or more than the inclination angle threshold θth (θ>θth), the rear wheel lifting determination section 54 determines elimination of the rear wheel lifting state and turns off the rear wheel lifting flag (rear wheel lifting flag=0) (step S512). Then, the controller 5 returns to step S501 and repeats the processing.

As described above, since the controller 5 determines the rear wheel lifting state based on the temporal change rate of the operation state of the bucket 23 and the temporal change rate of the inclination state of the vehicle body, as compared with a case of determining the rear wheel lifting state based on the operation state of the bucket 23 and the inclination state of the vehicle body, the rear wheel lifting state can be determined with higher accuracy.

In the case of making determination for an angle condition in which the bucket operation angle Φ is equal to or more than the tilt angle threshold Φth (Φ≥Φth) necessary for the start of the excavation operation and the vehicle body inclination angle θ is equal to or less than the inclination angle threshold θth (θ≤θth), for example, there is a possibility that the angle condition is satisfied when the wheel loader 1 tilts the bucket 23 while traveling on a downward slope. In this way, erroneous determination of the rear wheel lifting may easily occur.

On the other hand, in the case of making determination for the temporal change rate condition based on the temporal change rate α of the bucket operation angle and the temporal change rate β of the vehicle body inclination angle, since occurrence of change in the bucket operation angle Φ and occurrence of change in the vehicle body inclination angle θ are included in the determination condition of the rear wheel lifting, it is possible to reduce the erroneous determination of the rear wheel lifting which may occur while the wheel loader 1 is traveling on a downward slope.

<First Modification>

Figure 8:
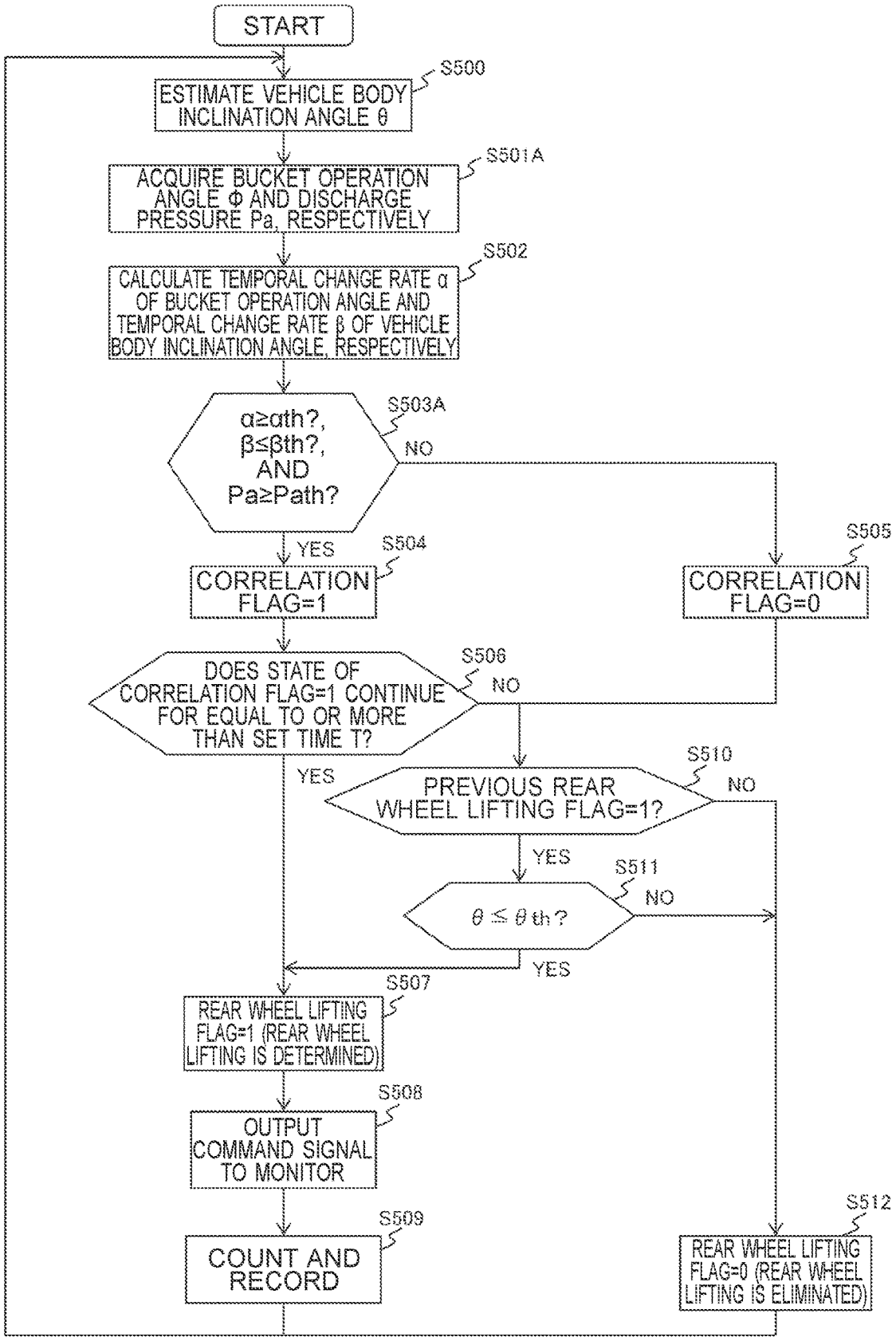
FIG. 8 illustrates a flowchart of processing executed by a controller according to a first modification.

Next, the controller 5 according to a first modification will be described with reference to FIG. 8. In FIG. 8, components common to those described for the controller 5 according to the above-described embodiment are provided with the same reference signs, and repetitive explanation thereof will be omitted. The above is also applied to the second to fourth embodiments which will be described later.

FIG. 8 illustrates a flowchart of processing executed by the controller 5 according to the first modification.

In the case of the controller 5 according to the first modification, the data acquisition section 50 is configured to acquire the discharge pressure Pa of the hydraulic pump 31 detected by the discharge pressure sensor 41 in addition to the bucket operation angle Φ detected by the bucket IMU 43 (step S501A).

Then, the correlation determination section 53 determines whether the temporal change rate α of the bucket operation angle calculated in step S502 is equal to or more than the first change rate threshold αth, the temporal change rate β of the vehicle body inclination angle calculated in step S502 is equal to or less than the second change rate threshold βth, and the discharge pressure Pa acquired in step S501A is equal to or more than a discharge pressure threshold Path (step S503A). Here, the "discharge pressure threshold Path" is the discharge pressure necessary for the tilt operation of the bucket 23 at the start of the excavation operation.

When it is determined in step S503A that the temporal change rate α of the bucket operation angle is equal to or more than the first change rate threshold αth (α≥αth), the temporal change rate β of the vehicle body inclination angle is equal to or less than the second change rate threshold βth (β≤βth), and the discharge pressure Pa is equal to or more than the discharge pressure threshold Path (Pa≥Path) (step S503A/YES), the controller 5 proceeds to step S504 and the correlation determination section 53 turns on the correlation flag (correlation flag=1). That is, as the condition for turning on the correlation flag, in addition to the temporal change rate of the bucket operation angle and the temporal change rate of the vehicle body inclination angle, the discharge pressure Pa detected by the discharge pressure sensor 41 needs to become the discharge pressure necessary for the tilt operation of the bucket 23 during the excavation operation.

On the other hand, when it is determined in step S503A that the temporal change rate α of the bucket operation angle is less than the first change rate threshold αth (α<αth), the temporal change rate β of the vehicle body inclination angle is more than the second change rate threshold βth (β>βth), or the discharge pressure Pa is less than the discharge pressure threshold Path (Pa<Path) (step S503A/NO), the controller 5 proceeds to step S505 and the correlation determination section 53 turns off the correlation flag (correlation flag=0).

As described above, by adding whether the discharge pressure Pa of the hydraulic pump 31 is equal to or more than the discharge pressure threshold Path to the condition for the correlation determination in the controller 5, it is possible to identify a state in which a load is applied to the bucket 23 by the excavation operation which is a premise of occurrence of rear wheel lifting. As a result, the rear wheel lifting state can be more accurately determined.

In the present modification, the discharge pressure Pa of the hydraulic pump 31 is used as the condition for specifying the state in which the load is applied to the bucket 23 by the excavation operation. Meanwhile, the present modification is not limited thereto, and for example, the bottom pressure of the bucket cylinder 24 may be used. However, since the bottom pressure of the bucket cylinder 24 is easy to fluctuate due to vibration, etc. of the vehicle body, it is desirable to use the discharge pressure Pa of the hydraulic pump 31.

<Second Modification>

Next, the configuration of the controller 5 according to a second modification will be described with reference to FIG. 9.

Figure 9:
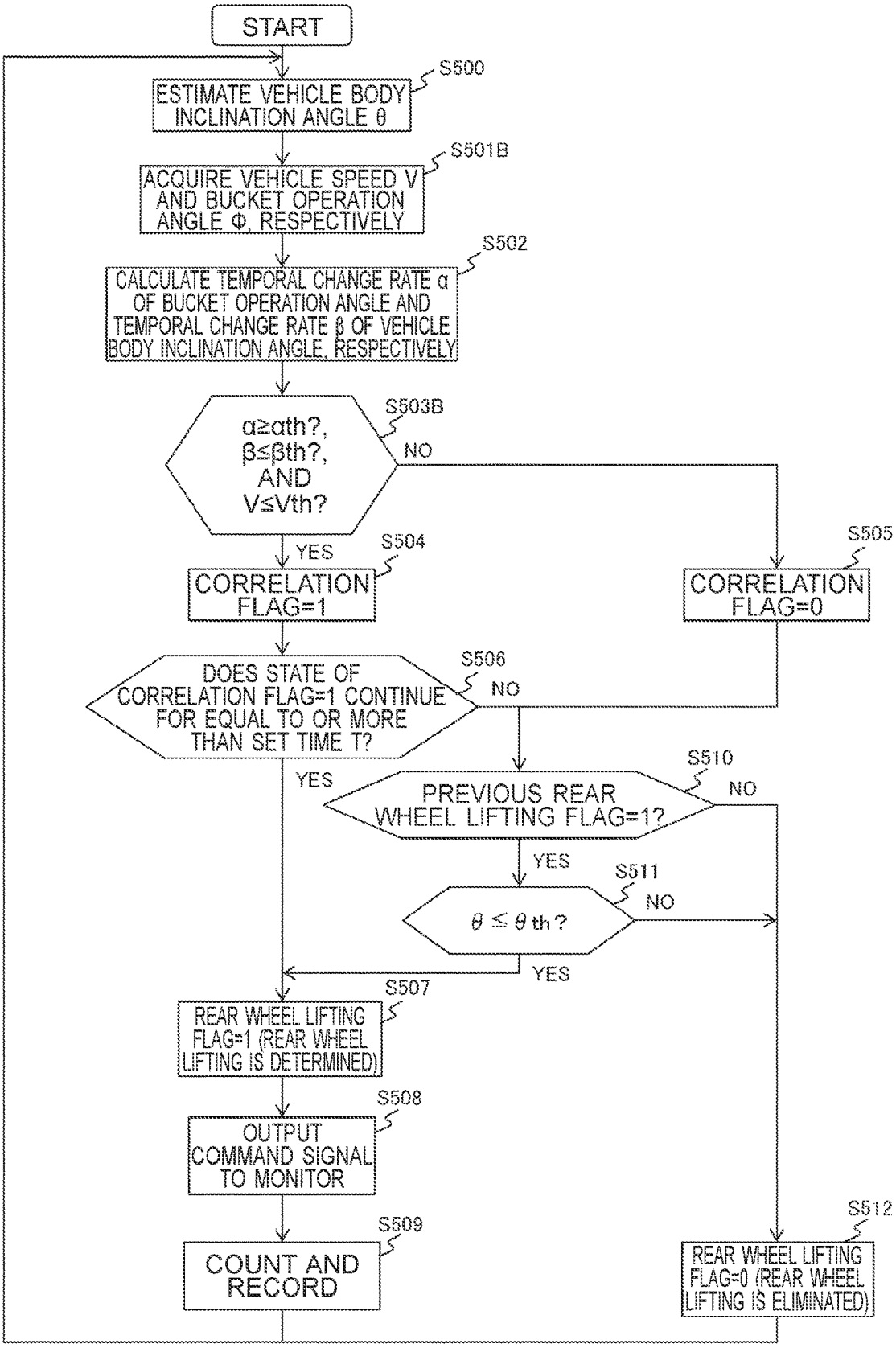
FIG. 9 illustrates a flowchart of processing executed by a controller according to a second modification.

FIG. 9 illustrates a flowchart of processing executed by the controller 5 according to the second modification.

In the case of the controller 5 according to the second modification, the data acquisition section 50 is configured to acquire the vehicle speed V detected by the vehicle speed sensor 45 in addition to the bucket operation angle Φ detected by the bucket IMU 43 (step S501B).

Then, the correlation determination section 53 determines whether the temporal change rate α of the bucket operation angle calculated in step S502 is equal to or more than the first change rate threshold αth, the temporal change rate β of the vehicle body inclination angle calculated in step S502 is equal to or less than the second change rate threshold βth, and the vehicle speed V acquired in step S501B is equal to or less than a low speed threshold Vth (step S503B). Here, the "low speed threshold Vth" is the vehicle speed corresponding to the excavation operation, and is the vehicle speed at the time when a first speed stage or a second speed stage is selected as the speed stage.

When it is determined in step S503B that the temporal change rate α of the bucket operation angle is equal to or more than the first change rate threshold αth (α≥αth), the temporal change rate β of the vehicle body inclination angle is equal to or less than the second change rate threshold βth (β≤βth), and the vehicle speed V is equal to or less than the low speed threshold Vth (V≤Vth) (step S503B/YES), the controller 5 proceeds to step S504 and the correlation determination section 53 turns on the correlation flag (correlation flag=1).

On the other hand, when it is determined in step S503B that the temporal change rate α of the bucket operation angle is less than the first change rate threshold αth (α<αth), the temporal change rate β of the vehicle body inclination angle is more than the second change rate threshold βth (β>βth), or the vehicle speed V is more than the low speed threshold Vth (V>Vth) (step S503B/NO), the controller 5 proceeds to step S505 and the correlation determination section 53 turns off the correlation flag (correlation flag=0).

As described above, by adding whether the vehicle speed V is equal to or less than the low speed threshold Vth to the condition for the correlation determination in the controller 5, it is possible to identify that the excavation operation is being performed which is a premise of occurrence of rear wheel lifting. As a result, the rear wheel lifting state can be more accurately determined.

<Third Modification>

Next, the configuration of the controller 5 according to a third modification will be described with reference to FIG. 10.

Figure 10:
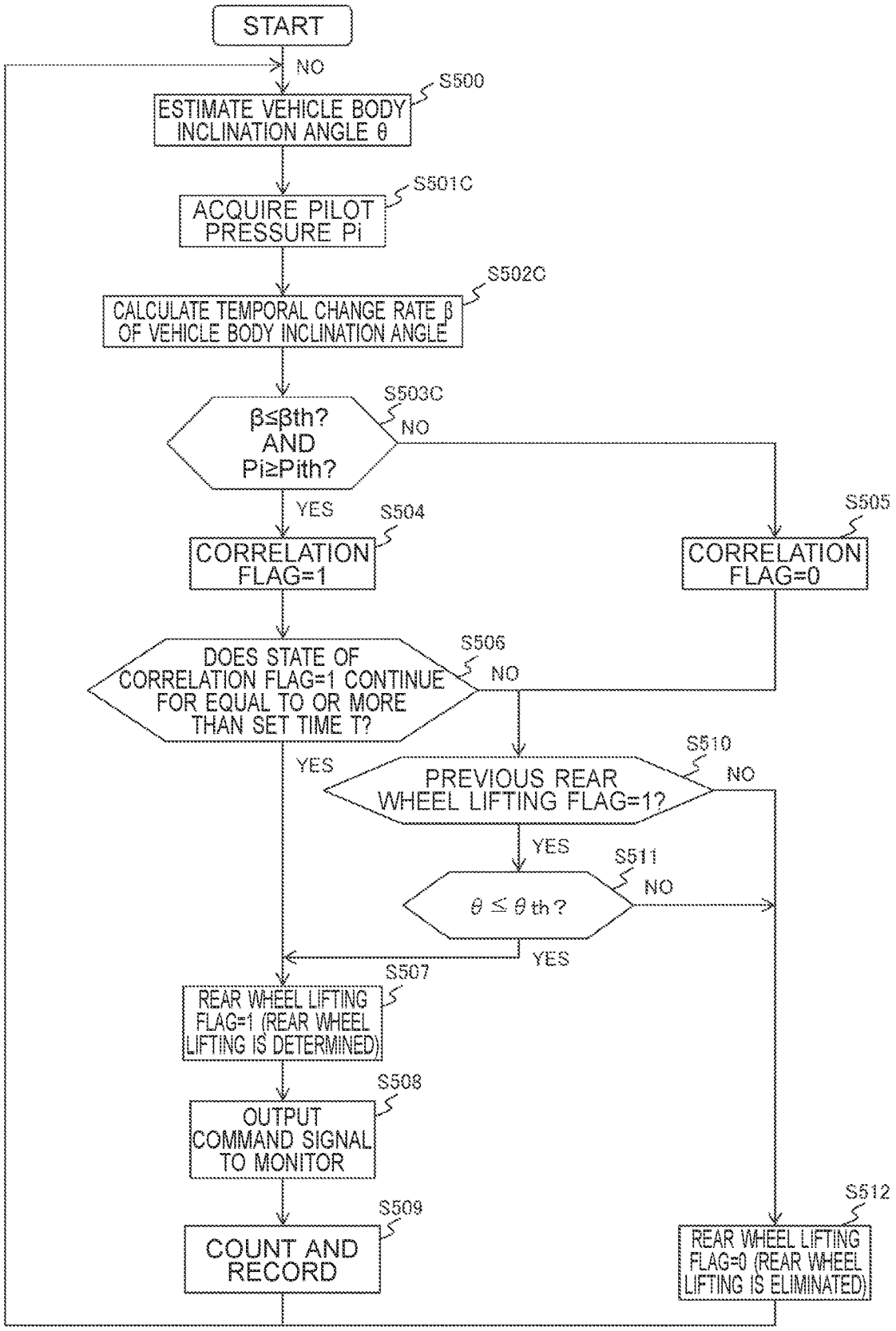
FIG. 10 illustrates a flowchart of processing executed by a controller according to a third modification.

FIG. 10 illustrates a flowchart of processing executed by the controller 5 according to the third modification.

In the case of the controller 5 according to the third modification, instead of the temporal change rate α of the bucket operation angle, correlation determination is performed by using an operation amount of the bucket operation lever 23A which is proportional to the temporal change rate α of the bucket operation angle. In the present modification, as one of the aspects of the bucket operation amount, pilot pressure relating to an operation of the bucket 23 is used.

Firstly, the data acquisition section 50 acquires the pilot pressure Pi relating to the operation of bucket 23 which is detected by the pilot pressure sensor 42 (step S501C). Next, the change rate calculation section 52 calculates only the temporal change rate β of the vehicle body inclination angle (step S502C).

Next, the correlation determination section 53 determines whether the temporal change rate β of the vehicle body inclination angle calculated in step S502C is equal to or less than the second change rate threshold βth and the pilot pressure Pi acquired in step S501C is equal to or more than an operation amount threshold Pith (step S503C). Here, the "operation amount threshold Pith" is a tilt operation amount of the bucket 23 necessary for the tilt operation of the bucket 23 at the start of the excavation operation, and has been stored in the storage section 57.

When it is determined in step S503C that the temporal change rate β of the vehicle body inclination angle is equal to or less than the second change rate threshold (βth (β≤βth) and the pilot pressure Pi is equal to or more than the operation amount threshold Pith (Pi≥Pith) (step S503C/YES), the controller 5 proceeds to step S504 and the correlation determination section 53 turns on the correlation flag (correlation flag=1).

On the other hand, when it is determined in step S503C that the temporal change rate β of the vehicle body inclination angle is more than the second change rate threshold (βth (β>βth) or the pilot pressure Pi is less than the operation amount threshold Pith (Pi<Pith) (step S503C/NO), the controller 5 proceeds to step S505 and the correlation determination section 53 turns off the correlation flag (correlation flag=0).

As described above, the correlation determination section 53 may be configured to determine the correlation between the operation state of the bucket 23 and the inclination state of the vehicle body based on the temporal change rate β of the vehicle body inclination angle and the pilot pressure Pi relating to the operation of the bucket 23. In the present modification as well, it is possible to obtain the same operations and effects as those in the above-described embodiment.

<Fourth Modification>

Next, the configuration of the controller 5 according to a fourth modification will be described with reference to FIG. 11.

Figure 11:
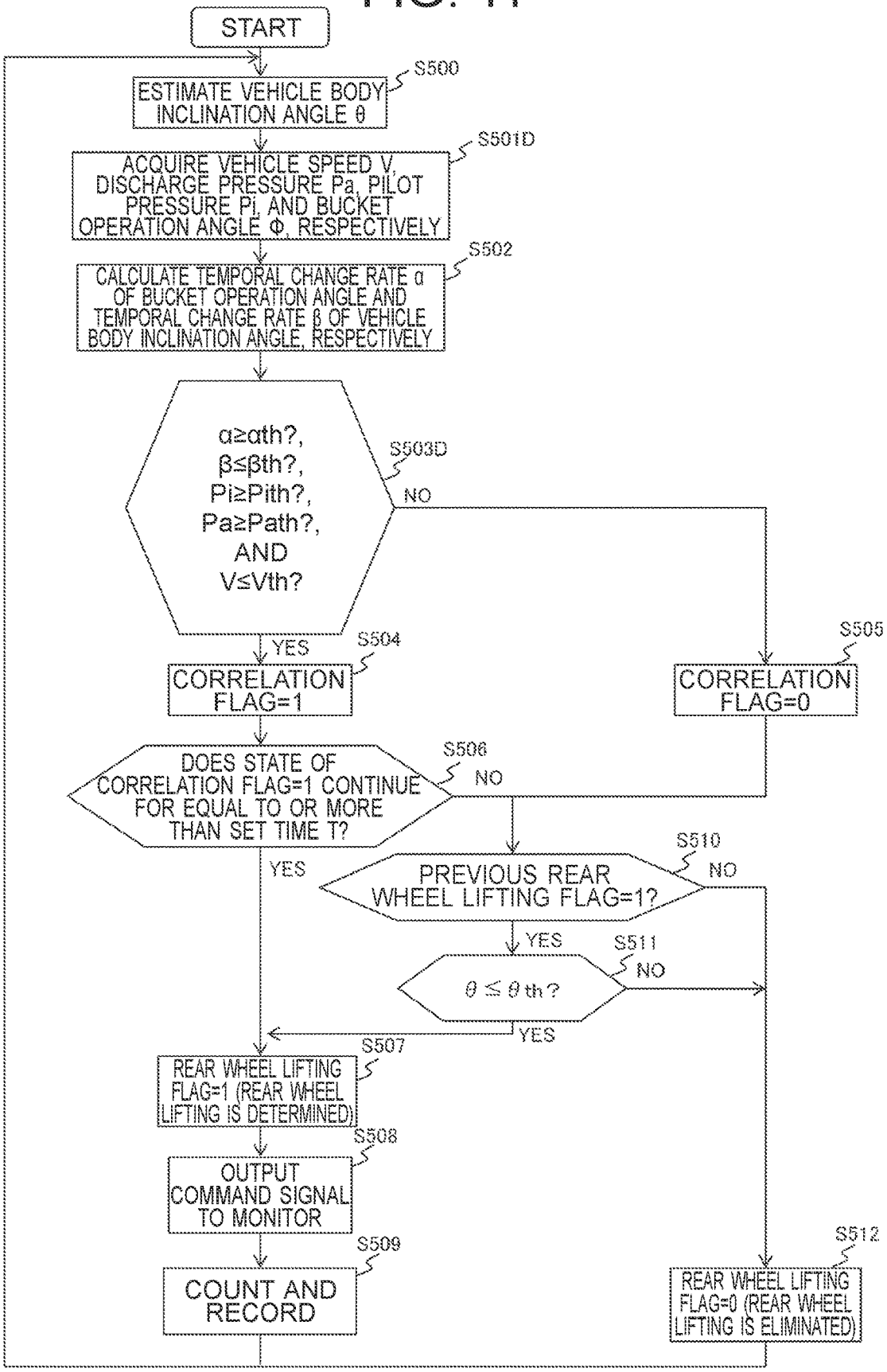
FIG. 11 illustrates a flowchart of processing executed by a controller according to a fourth modification.

FIG. 11 illustrates a flowchart of processing executed by the controller 5 according to the fourth modification.

In the case of the controller 5 according to the fourth modification, the data acquisition section 50 is configured to acquire the discharge pressure Pa of the hydraulic pump 31 detected by the discharge pressure sensor 41, the pilot pressure Pi detected by the pilot pressure sensor 42, the bucket operation angle Φ detected by the bucket IMU 43, and the vehicle speed V detected by the vehicle speed sensor 45, respectively (step S501D).

The correlation determination section 53 determines whether the temporal change rate α of the bucket operation angle calculated in step S502D is equal to or more than the first change rate threshold αth, the temporal change rate β of the vehicle body inclination angle calculated in step S502D is equal to or less than the second change rate threshold βth, the pilot pressure Pi acquired in step S501D is equal to or more than the operation amount threshold Pith, the discharge pressure Pa acquired in step S501D is equal to or more than the discharge pressure threshold Path, and the vehicle speed V acquired in step S501D is equal to or less than the low speed threshold Vth (step S503B).

When it is determined in step S503D that the temporal change rate α of the bucket operation angle is equal to or more than the first change rate threshold αth (α≥αth), the temporal change rate β of the vehicle body inclination angle is equal to or less than the second change rate threshold βth (β≤βth), the pilot pressure Pi is equal to or more than the operation amount threshold Pith (Pi≥Pith), the discharge pressure Pa is equal to or more than the discharge pressure threshold Path (Pa≥Path), and the vehicle speed V is equal to or less than the low speed threshold Vth (V≤Vth) (step S503D/YES), the controller 5 proceeds to step S504 and the correlation determination section 53 turns on the correlation flag (correlation flag=1).

On the other hand, when it is determined in step S503D that the temporal change rate α of the bucket operation angle is less than the first change rate threshold αth (α<αth), the temporal change rate β of the vehicle body inclination angle is more than the second change rate threshold βth (β>βth), the pilot pressure Pi is less than the operation amount threshold Pith (Pi<Pith), the discharge pressure Pa is less than the discharge pressure threshold Path (Pa<Path), or the vehicle speed V is more than the low speed threshold Vth (V>Vth) (step S503D/NO), the controller 5 proceeds to step S505 and the correlation determination section 53 turns off the correlation flag (correlation flag=0).

That is, in the present modification, the correlation determination section 53 turns on the correlation flag (correlation flag=1) when all the conditions for the correlation determination described in the above-mentioned embodiment and the first to third modifications are satisfied. With this configuration, the controller 5 can determine the rear wheel lifting state with higher accuracy.

In the above, the embodiment and the modifications of the present invention have been described. It should be noted that the present invention is not limited to the embodiment and the modifications described above, and various modifications are included. For example, the embodiment described above has been explained in detail in order to clarify the present invention, but is not necessarily limited to those having all the configurations described. In addition, a part of the configuration of the present embodiment can be replaced with that of another embodiment, and the configuration of another embodiment can be added to the configuration of the present embodiment. Furthermore, it is possible to add, delete, or replace another configuration with respect to a part of the configuration of the present embodiment.

REFERENCE SIGNS LIST

1: wheel loader
1A: front frame (front vehicle body)
1B: rear frame (rear vehicle body)
2: working device
5: controller
11A: front wheel
11B: rear wheel
12A: monitor
23: bucket
23A: bucket operation lever (bucket operation device)
24: bucket cylinder (hydraulic cylinder)
31: hydraulic pump
41: discharge pressure sensor
42: pilot pressure sensor (operation amount sensor, operation state sensor)
43: bucket IMU (bucket angle sensor, operation state sensor)
44: vehicle body IMU (inclination angle sensor, inclination state sensor)
45: vehicle speed sensor (inclination angle sensor, inclination state sensor)

The invention claimed is:

1. A wheel loader comprising:

a vehicle body formed by a front vehicle body and a rear vehicle body;

front wheels provided on the front vehicle body and rear wheels provided on the rear vehicle body; and a working device attached to the front vehicle body and having a bucket used in an excavation operation, wherein the wheel loader further comprises:

an operation state sensor configured to detect an operation state of the bucket;

an inclination state sensor configured to detect an inclination state of the vehicle body;

a controller configured to determine a rear wheel lifting state in which the rear wheels are lifted in an upward direction by excavation reaction force of the working device, and the controller is further configured to:

in cases where a temporal change rate of the operation state of the bucket detected by the operation state sensor is a first temporal change rate which is a temporal change rate of the operation state of the bucket necessary for a tilt operation of the bucket during the excavation operation, and where a temporal change rate of the inclination state of the vehicle body detected by the inclination state sensor is a second temporal change rate which is a temporal change rate of an obliquely upward inclination state of the rear vehicle body with respect to the front vehicle body, turn on a correlation flag indicating a correlation between the operation state of the bucket and the inclination state of the vehicle body to determine the rear wheel lifting state.

2. The wheel loader according to claim 1, wherein the controller is further configured to determine the rear wheel lifting state in a case where a state in which the correlation flag is turned on continues for equal to or more than a predetermined set time.

3. The wheel loader according to claim 1, wherein the operation state sensor is a bucket angle sensor configured to detect an operation angle of the bucket, the inclination state sensor is an inclination angle sensor configured to detect an inclination angle of the vehicle body with respect to a horizontal direction, and the controller is further configured to determine the rear wheel lifting state based on a temporal change rate of the operation angle of the bucket detected by the bucket angle sensor and a temporal change rate of the inclination angle of the vehicle body detected by the inclination angle sensor.

4. The wheel loader according to claim 1, further comprising:

a hydraulic pump that supplies hydraulic oil to a hydraulic cylinder that drives the bucket; and a discharge pressure sensor configured to detect discharge pressure of the hydraulic pump, wherein the controller is further configured to determine the rear wheel lifting state in cases where the temporal change rate of the operation state of the bucket detected by the operation state sensor is the first temporal change rate, where the temporal change rate of the inclination state of the vehicle body detected by the inclination state sensor is the second temporal change rate, and where the discharge pressure of the hydraulic pump detected by the discharge pressure sensor becomes discharge pressure necessary for the tilt operation of the bucket during the excavating operation.

5. The wheel loader according to claim 1, further comprising a bucket operation device for operating the bucket, wherein the operation state sensor is an operation amount sensor configured to detect an operation amount of the bucket operation device which is proportional to the temporal change rate of the operation state of the bucket, the inclination state sensor is an inclination angle sensor configured to detect an inclination angle of the vehicle body with respect to a horizontal direction, and the controller is further configured to determine the rear wheel lifting state based on the operation amount of the bucket operation device detected by the operation amount sensor and the temporal change rate of the inclination angle of the vehicle body detected by the inclination angle sensor.

6. The wheel loader according to claim 1, further comprising a vehicle speed sensor configured to detect vehicle speed, wherein the controller is further configured to determine the rear wheel lifting state in cases where the temporal change rate of the operation state of the bucket detected by the operation state sensor is the first temporal change rate, where the temporal change rate of the inclination state of the vehicle body detected by the inclination state sensor is the second temporal change rate, and where the vehicle speed detected by the vehicle speed sensor is vehicle speed corresponding to the excavation operation.

7. The wheel loader according to claim 1, wherein the controller is further configured to, in a case of determining the rear wheel lifting state, output to a monitor that the vehicle body is in the rear wheel lifting state.

* * * * *